US005632613A

United States Patent [19]

Shin et al.

[11] Patent Number: 5,632,613

[45] Date of Patent: May 27, 1997

[54] LUBRICATING DEVICE FOR HORIZONTAL TYPE HERMETIC COMPRESSOR

[75] Inventors: Chang J. Shin, Seoul; Jong D. Moon, Kyungki-Do, both of Rep. of Korea

[73] Assignee: Goldstar Co., Ltd., Rep. of Korea

[21] Appl. No.: 529,750

[22] Filed: Sep. 18, 1995

Related U.S. Application Data

[62] Division of Ser. No. 167,322, Dec. 14, 1993, Pat. No. 5,470,214.

[30] Foreign Application Priority Data

Dec. 17, 1992 [KR] Rep. of Korea ..... 24713/1992
Dec. 31, 1992 [KR] Rep. of Korea ..... 27116/1992

[51] Int. Cl.[6] ..... F04C 18/356; F04C 29/02

[52] U.S. Cl. ..... 418/63; 418/88; 418/94

[58] Field of Search ..... 418/63, 88, 94, 418/96

[56] References Cited

FOREIGN PATENT DOCUMENTS 56-20795 2/1981 Japan ..... 418/88
60-204994 10/1985 Japan ..... 418/94
60-237192 11/1985 Japan ..... 418/88
1232192 9/1989 Japan ..... 418/63

*Primary Examiner*—John J. Vrablik
*Attorney, Agent, or Firm*—Ostrolenk, Faber, Gerb & Soffen, LLP

[57] ABSTRACT

A lubricating device for a horizontal type hermetic compressor. The device includes an oil cylinder at the back of a spring-biased vane in a compressing cylinder, and also includes an oil piston and an oil valve in the oil cylinder. The oil piston communicates with the oil valve by the movement of the vane, thus to achieve the lubrication oil supply through the oil cylinder. The oil piston is biased by a compression coil spring positioned under the piston, so that it is easy to fabricate the compressor. Since the length of the oil piston is longer than the distance between the upper dead point of the oil pumping chamber and the vane slot reference hole, introduction of refrigerant into the oil cylinder is reliably prevented. This device uses a conventional horizontal type hermetic compressor with a slight change of its construction and easily precisely controls the flow rate of the lubrication oil to be delivered. The lubricating device also remarkably reduces the oil suction load in the pumping chamber and, as a result, the desired smooth introduction of the lubrication oil into the pumping chamber is achieved.

2 Claims, 10 Drawing Sheets

LUBRICATING DEVICE FOR HORIZONTAL TYPE HERMETIC COMPRESSOR

This is a division of application Ser. No. 08/167,322, filed Dec. 14, 1993 now U.S. Pat. No. 5,470,214.

BACKGROUND OF THE INVENTION

1. Field of the Invention

The present invention relates in general to a lubrication for a horizontal type hermetic compressor and, more particularly, to a lubricating device for the horizontal type hermetic compressor.

2. Description of the Prior Art

As well known to those skilled in the art, hermetic compressors are generally classified into two types, that is, vertical type hermetic compressors and horizontal type hermetic compressors. The above classification of the hermetic compressors is according to location of their crank shafts. Otherwise stated, the crank shafts of the vertical type compressors are vertically positioned while the crank shafts of the horizontal type compressors are horizontally positioned. However, the hermetic compressors irrespective of their types should be provided with lubricating devices for supplying lubrication oil to their driving parts such as the crank shafts.

With reference to FIG. 1A, there is schematically shown a construction of a typical hermetic compressor of the vertical type. The vertical type hermetic compressor is encased by a vertical compressor casing 1*a* which is charged with lubrication oil "o" in its lower section. The lubrication oil surface is nearly leveled to a cylinder 2 as well as a main bearing 5*a* which are encased in the compressor casing 1*a* at the lower section of the casing 1*a*. The cylinder 3 receives a crank shaft 4*a* which has an oil port 5 provided with a lubricating propeller (not shown). When the crank shaft 4*a* is rotated in the cylinder 3, the lubricating propeller provided at the oil port 5 is also rotated in order to supply the lubricating oil "o" to the driving parts of the compressor.

Turning to FIGS. 1B and 1C, there is shown a construction of a typical horizontal type hermetic compressor. This compressor has a crank shaft which is horizontally positioned in a horizontal compressor casing 1 such that its axis is coaxial with the center axis of the casing 1. A lubricating device of this horizontal type hermetic compressor comprises a rotating shaft 4 which is concentrically received in a cylindrical cavity of a cylinder 2 defining a compression chamber C therein. The rotating shaft 4 is also coupled to an eccentric roller 3. The cylinder 2 is coupled at its both sides to a main bearing 5 and a sub bearing 6, respectively, which support the rotating shaft 4 at opposed sides of the cylinder 2 and define the compression chamber C in cooperation with the inner surface of the cylinder 2. The cylinder 2 also includes an oil pumping chamber 9 communicating with the inside of the casing 1 and pumping the lubrication oil "o" in the casing 1 in order to supply the oil to the driving parts of the compressor. This oil pumping chamber 9 is provided with an oil inlet-side hydraulic diode 10 at one side thereof corresponding to the main bearing 5 and with an oil outlet-side hydraulic diode 11 at the other side thereof corresponding to the sub bearing 6. A spring-biased vane 7 is radially received in the oil pumping chamber 9 such that its distal end comes into close contact the outer surface of the eccentric roller 3. When the eccentric roller 3 coupled to the shaft 4 is eccentrically rotated in the cavity of the cylinder 2 by the rotation of the shaft 4, the spring-biased vane 7 coming into close contact with the roller 3 elastically advances and retracts by the eccentric rotation of the roller 3. Thus, the lubrication oil "o" in the casing 1 flows in the oil pumping chamber 9 through the oil inlet-side diode 10 and, thereafter, is delivered to the driving parts of the compressor, such as the rotating shaft 4, through the oil outlet-side diode 11. The communication of the oil outlet-side diode 11 with the rotating shaft 4 is achieved by an oil feed pipe 12 connected therebetween.

In operation of the above horizontal type hermetic compressor, the eccentric rotation of the roller 3 coupled to the rotating shaft 4 makes the spring-biased vane 7 elastically advance and retract, thus to cause a change of inner volume of the oil pumping chamber 9 as well as an oil pressure difference between the pumping chamber 9, the oil feed pipe 12 and the inside of the casing 1. Hence, the lubrication oil "o" charged in the lower section of the casing 1 is forcibly supplied to the rotating shaft 4 through the oil inlet-side diode 10, the oil pumping chamber 9, the oil outlet-side diode 11 and the oil feed pipe 12.

Otherwise stated, when the vane 7 advances towards the cavity of the cylinder 2, the volume occupied by the vane 7 in the pumping chamber 9 is reduced and this causes generation of negative pressure in the pumping chamber 9. The lubrication oil in the casing 1 is thus sucked into the pumping chamber 9 through the oil inlet-side diode 10. At this time, the lubrication oil intending to reversely flow from the feed pipe 12 to the pumping chamber 9 is limited in its amount to be very small since the oil outlet-side diode 11 is reversely positioned. When the vane 7 retracts from the cavity of the cylinder 2, the inner volume of the pumping chamber 9 is reduced and, as a result, the oil in the chamber 9 is compressed. The lubrication oil under pressure is thus delivered to the rotating shaft 4 through the oil outlet-side diode 11 and the feed pipe 12. At this time, the lubrication oil intending to reversely flow from the pumping chamber 9 to the inside of the casing 1 is limited in its amount to be very small since the oil inlet-side diode 10 is reversely positioned. A predetermined amount of lubrication oil, that is, the difference between the amount of the lubrication oil flowing out through the oil outlet-side diode 11 and the amount of the lubrication oil flowing out through the oil inlet-side diode 10, is supplied to the friction parts of the driving parts of the compressor.

However, the conventional horizontal type hermetic compressor has a problem that since its compression chamber is defined by the cylinder 2, the main bearing 5 and the sub bearing 6, it can not use the cylinder, the main bearing and the sub bearing of the conventional vertical type hermetic compressor. Another problem of the conventional hermetic compressor is resided in that the delivery amount of the lubrication oil is determined by the geometrical characteristics of the oil inlet-side and oil outlet-side hydraulic diodes, so that it is difficult to control the flow rate of the lubrication oil.

SUMMARY OF THE INVENTION

It is, therefore, an object of the present invention to provide a lubricating device for a horizontal type hermetic compressor in which the above problems can be overcome and which can easily achieve a precise control of flow rate of the lubrication oil by use of minimum number of elements and slight change of the construction of the conventional hermetic compressor.

It is another object of the present invention to provide a lubricating device for a horizontal type hermetic compressor in which a compression coil spring is provided under an oil piston in an oil cylinder, thus to make it easy to fabricate the compressor.

In an aspect, the present invention provides a lubricating device for a horizontal type hermetic compressor, the compressor being encased by a horizontal outer casing which is charged with lubrication oil therein and includes a rotating shaft having an eccentric rotor positioned between a compression cylinder and a main bearing, comprising: an oil cylinder provided at the back of a movable vane received in a vane slot of the compression cylinder, the oil cylinder having an oil inlet port and an oil outlet port; an oil piston slidably received in the oil cylinder for suction and delivery of the lubrication oil; a piston connection member fixedly connected to the oil piston in the oil cylinder; a plurality of line springs penetrating and being connected to the piston connection member in order to fixedly couple the oil piston to the vane; an oil valve movably provided under the oil piston for selectively closing the oil inlet port of the oil cylinder in accordance with movement of the oil piston in the oil cylinder; and an oil feed pipe connected between the oil outlet port of the oil cylinder and the rotating shaft of the compressor for feeding the lubrication oil from the oil cylinder to the rotating shaft.

In another aspect, the present invention provides a lubricating device for a horizontal type hermetic compressor, the compressor being encased by a horizontal outer casing which is charged with lubrication oil in its lower section and includes a rotating shaft having an axial oil conduit therein and provided with an eccentric rotor positioned between a compression cylinder and a main bearing, comprising: a vane movably received in the compression cylinder in order to elastically vertically reciprocate in accordance with rotation of the eccentric rotor; a vane slot provided in a lower section of the compression cylinder and movably receiving the vane; a pumping chamber provided under the vane in the compression cylinder; an upper spring cap movably provided in an upper section of the pumping chamber such that it vertically reciprocates in accordance with the reciprocation of the vane, thus to change of an inner volume of the pumping chamber; a lower spring cap provided in a lower section of the pumping chamber; biasing means interposed between the upper and lower spring caps for biasing the upper spring cap upwards; an oil inlet port provided in the compression cylinder at a position spaced apart from the vane slot by a predetermined distance, the inlet port and having an inlet diode nozzle directed toward the pumping chamber; an oil outlet port provided in the compression chamber such that it is opposed to the oil inlet port, the oil outlet port having an outlet diode nozzle directed towards the outside of the pumping chamber; and an oil feed pipe connected between the outlet diode nozzle of the oil outlet port arid a lubricating adapter coupled to an end of the rotating shaft.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
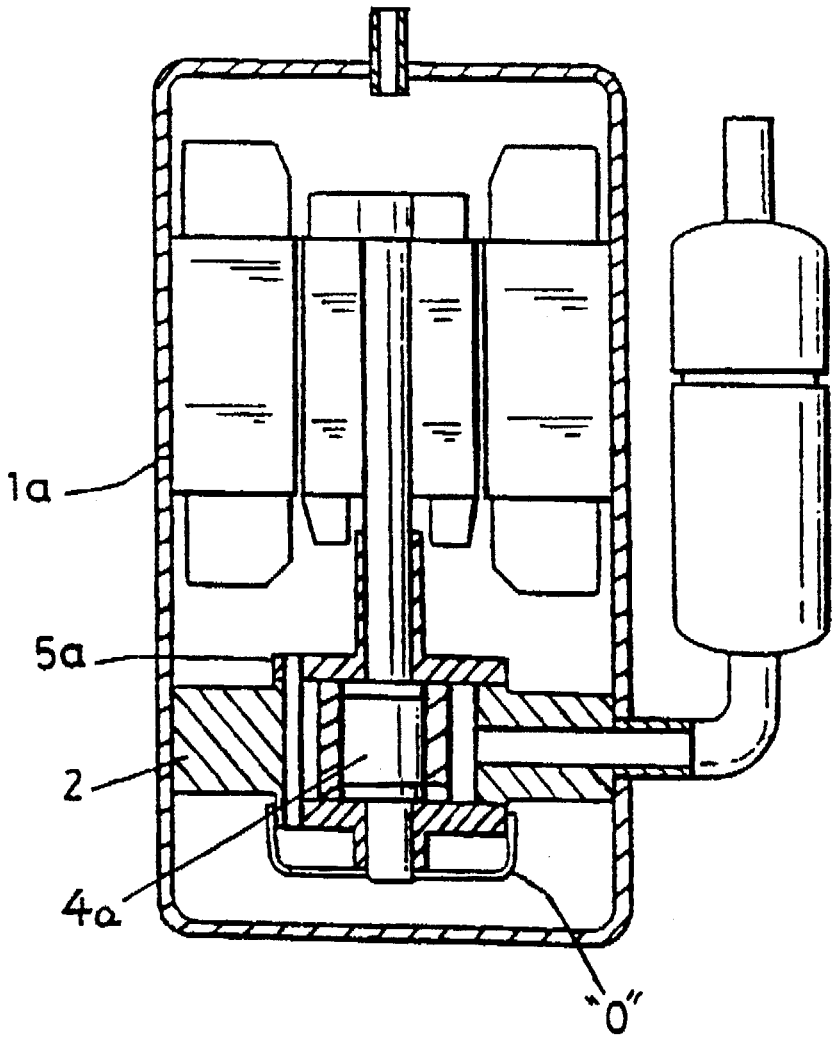
FIG. 1A CONVENTIONAL ART
FIG. 1A is a schematic sectional view showing a construction of a typical hermetic compressor of the vertical type.
Figure 1B:
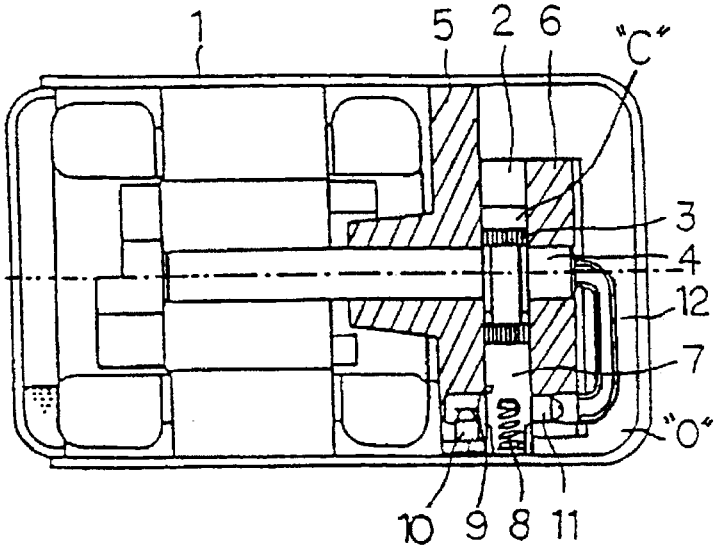
FIG 1B CONVENTIONAL ART
FIG. 1B is a longitudinal sectional view of a lubricating device for a typical hermetic compressor of the horizontal type.
Figure 1C:
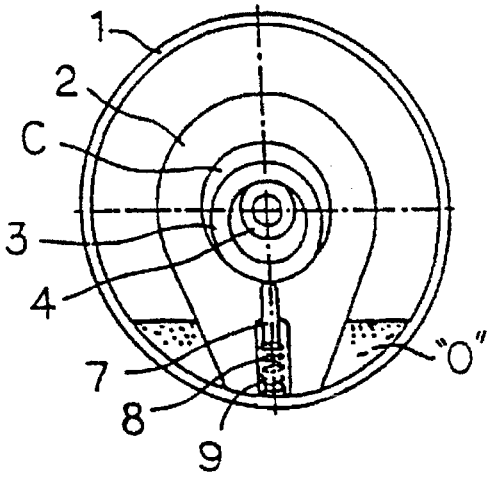
FIG 1C CONVENTIONAL ART
FIG. 1C is a cross sectional view of the lubricating device of FIG. 1B.
Figure 2:
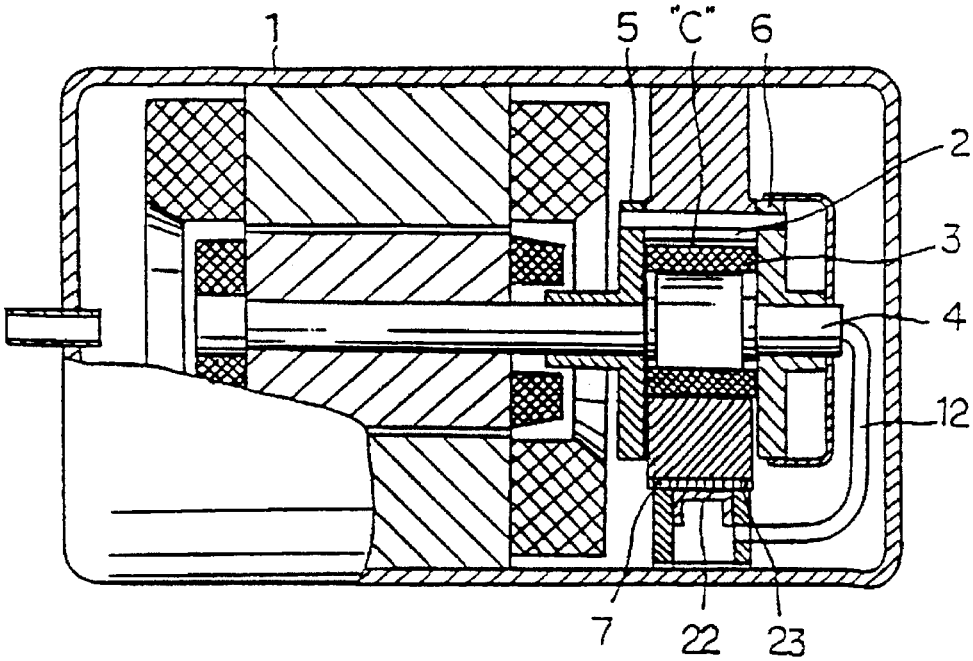
FIG. 2 is a longitudinal sectional view of a lubricating device for a horizontal type hermetic compressor in accordance with a primary embodiment of the present invention.
Figure 3:
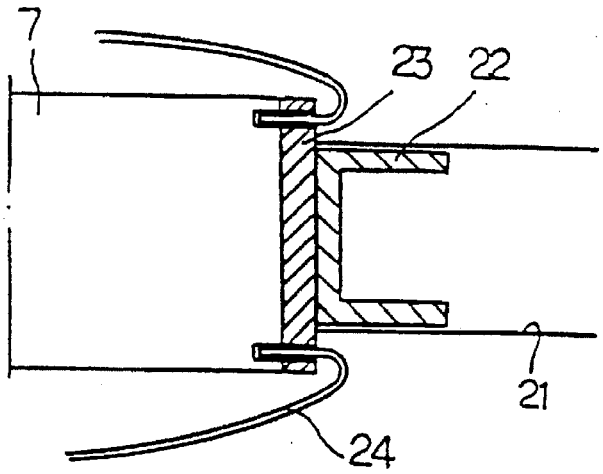
FIG. 3 is an enlarged sectional view showing a connection between a piston connection member and line springs of the lubricating device of FIG. 2.
Figure 4:
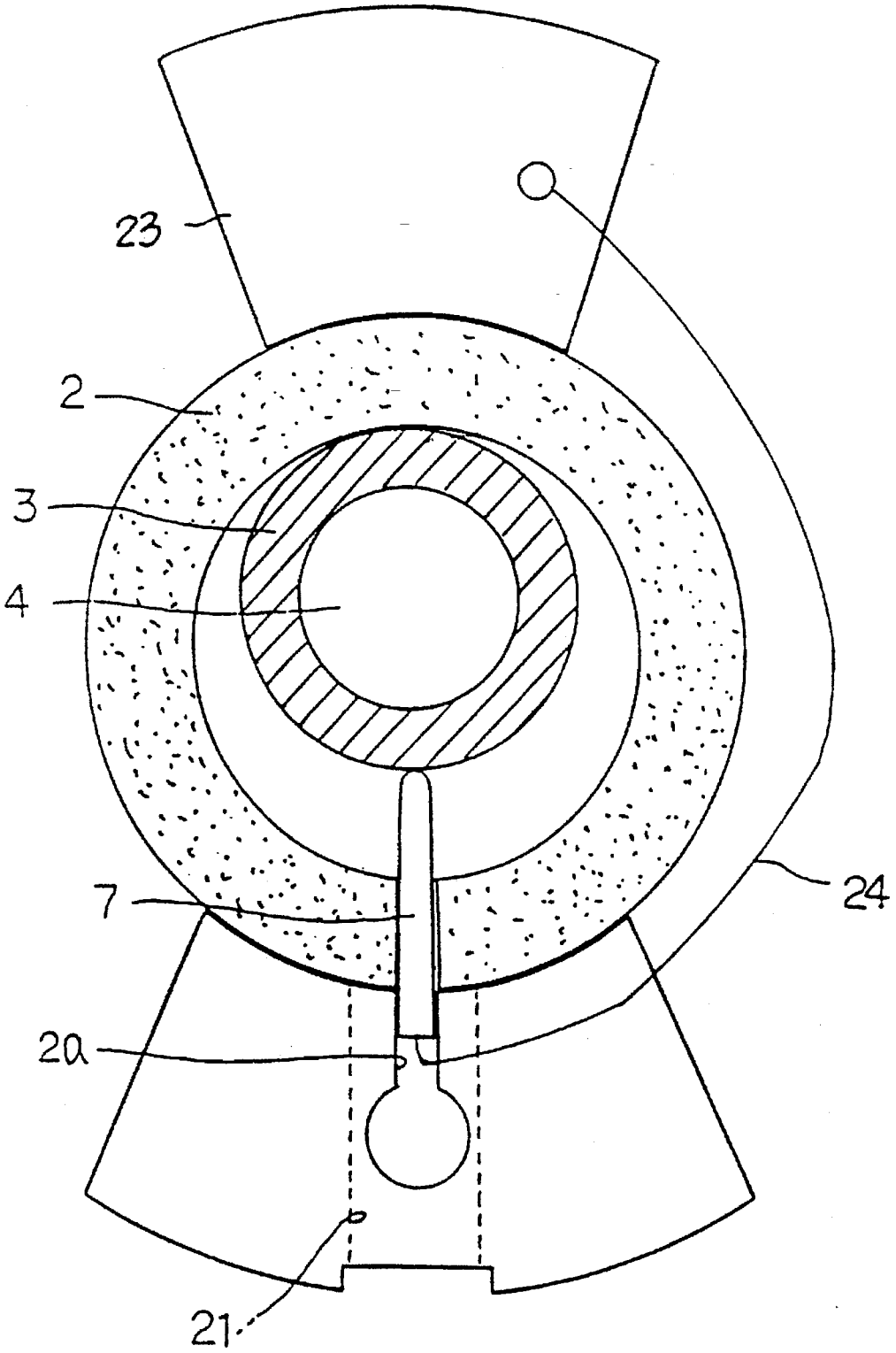
FIG. 4 is an enlarged cross sectional view of the lubricating device of FIG. 2.

FIG. 2 is a sectional view showing a lubricating device for a horizontal type hermetic compressor in accordance with a primary embodiment of the present invention, FIG. 3 is an enlarged sectional view showing a connection between a piston connection member and line springs of the lubricating device of FIG. 2, and FIG. 4 is an enlarged cross sectional view of the lubricating device of FIG. 2. In accordance with this primary embodiment, the lubricating device comprises an eccentric rotating shaft 4 which is eccentrically received in a cylindrical cavity of a cylinder 2 defining a compression chamber C therein. The rotating shaft 4 is also provided with a roller 3 thereabout such that this roller 3 is rotated at the same time of rotation of the shaft 4. The cylinder 2 is coupled at its both sides to a main bearing 5 and a sub bearing 6, respectively, which support the rotating shaft 4 at opposed sides of the cylinder 2 and define the compression chamber C. in cooperation with the inner surface of the cylinder 2. The cylinder 2 also includes a vane slot 2*a* in which a spring-biased vane 7 is radially received such that its distal end comes into close contact with the outer surface of the roller 3. When the roller 3 of the eccentric rotating shaft 4 is eccentrically rotated in the cavity of the cylinder 2 by the eccentric rotation of the shaft 4, the vane 7 elastically advances and retracts. An oil cylinder 21 functioning as an oil pumping chamber is provided in the cylinder 2 at the back of the vane 7 and has an oil inlet port 21*a* and an oil outlet port 21*b* at its bottom and at its side wall, respectively. The oil cylinder 21 communicates with the inside of the casing 1 through the oil inlet port 21*a* and supplies the lubrication oil to the driving parts of the compressor through the oil outlet port 21*b*.

Figure 5:
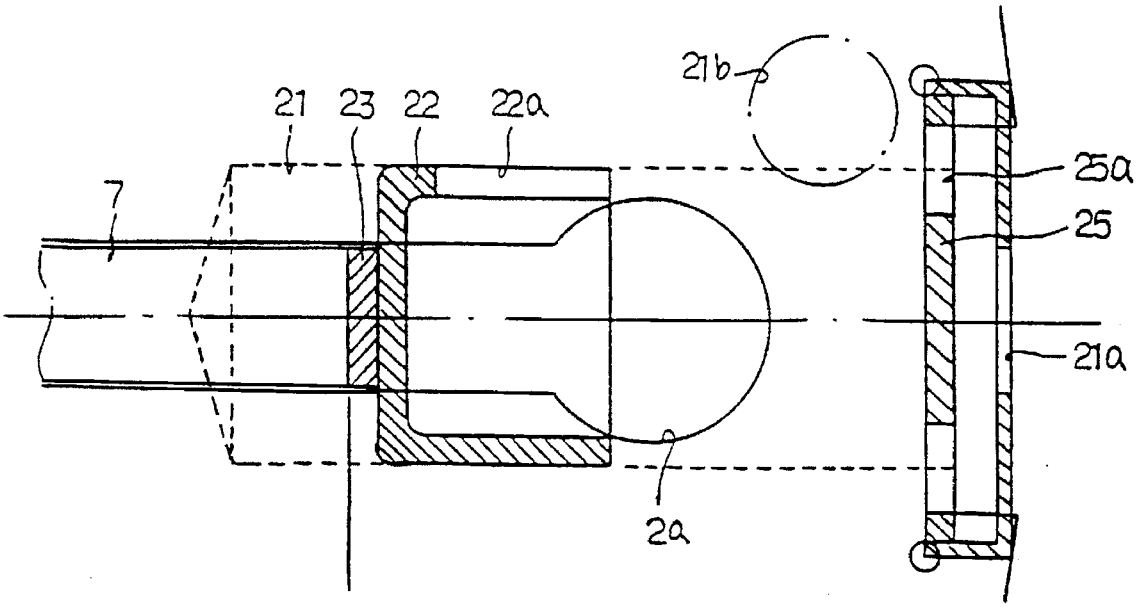
FIG. 5 is a schematic sectional view showing an oil sucking operation of the lubricating device of FIG. 2.
Figure 6:
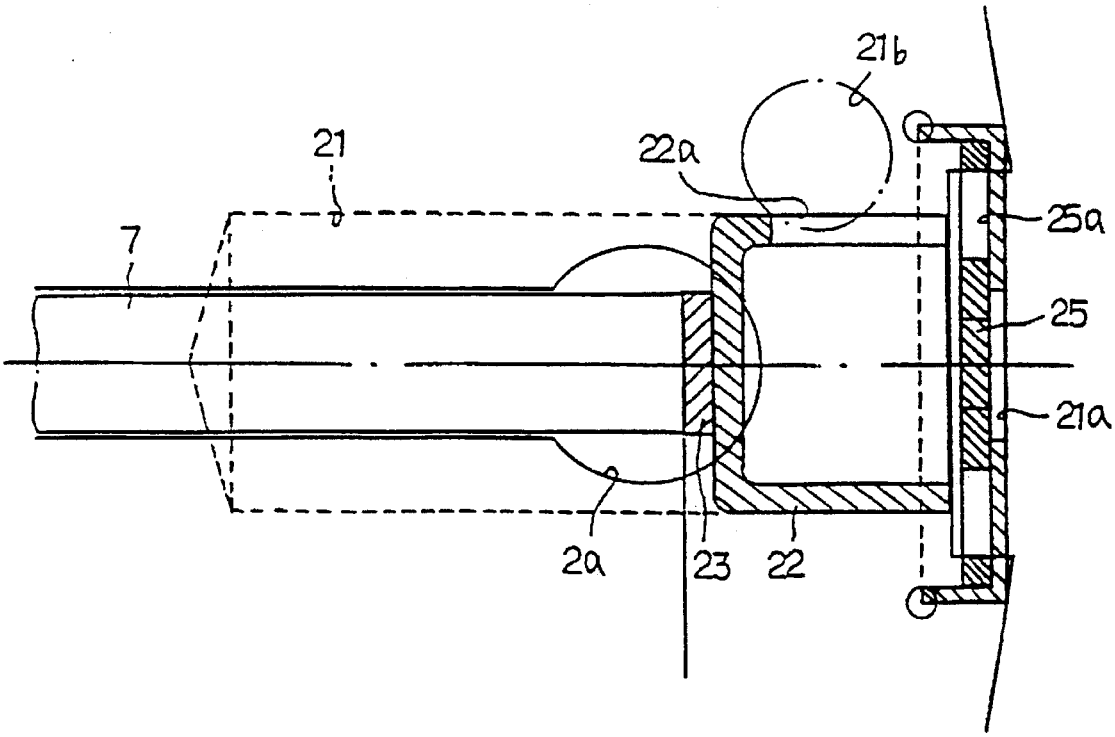
FIG. 6 is a schematic sectional view showing an oil delivering operation of the lubricating device of FIG. 2.

As shown in FIGS. 2 and 3, the oil cylinder 21 receives an oil piston 22 for suction and delivery of the lubrication oil. A piston connection member 23 is welded to the upper surface of the oil piston 22. This oil piston 22 is in turn fixedly coupled to the vane 7 by a plurality of line springs 24 which penetrate and are connected to the piston connection member 23. Thus, the oil piston 22 radially advances and retracts in cooperation with the radial movement of the vane 7. As shown in FIGS. 5 and 6 showing the oil sucking operation and the oil delivering operation of the lubricating device of FIG. 2 respectively, an oil valve 25 is movably provided above the oil inlet port 21*a* for closing or opening the inlet port 21*a* in accordance with a sliding movement of the oil piston 22 in the cylinder 21. In addition, an oil feed pipe 12 is connected between the oil outlet port 21*b* and the eccentric rotating shaft 4 for feeding the lubrication oil from the oil cylinder 21 to the shaft 4.

Each of the line springs 24 fixedly connects the piston connection member 23 welded to the oil piston 22 to the vane 7, thus to fixedly connect the oil piston 22 to the vane 7. In this regard, the oil piston 22 radially advances and retracts in cooperation with the radial reciprocation of the vane 7.

In order to cause delivery of the lubrication oil from the oil cylinder 21 to the shaft 4 through the oil outlet port 21*b* of the cylinder 21 when the oil piston 22 radially retracts in cooperation with the retraction of the vane 7, the oil piston 22 is provided at its side wall with an oil outlet 22*a* corresponding and opening to the oil outlet port 21*b* of the oil cylinder 21 as shown in FIGS. 5 and 6.

The oil valve 25 includes an oil inlet hole 25*a*. The outer diameter of this valve 25 is larger than that of the oil cylinder 21.

Figure 7:
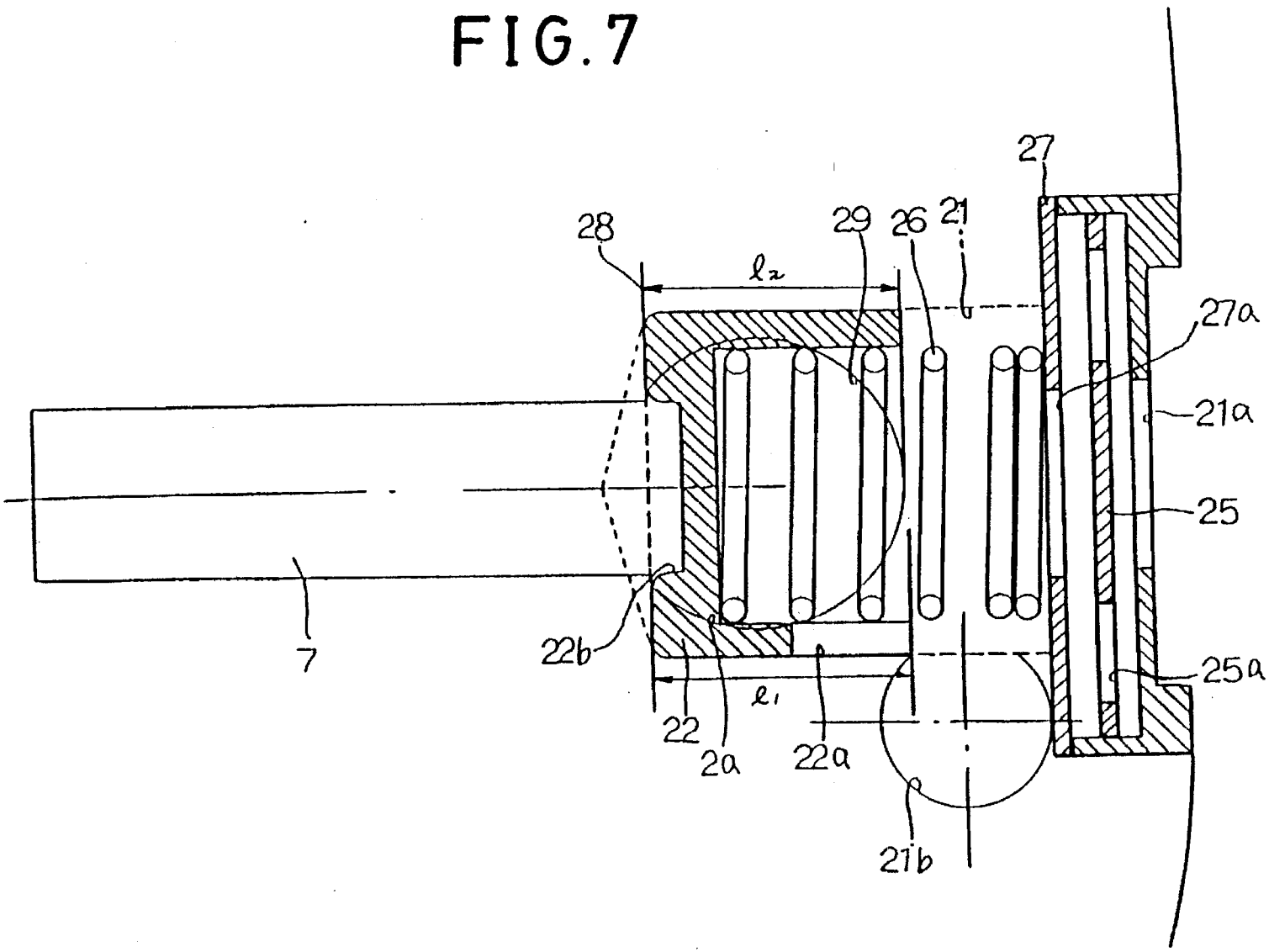
FIG. 7 is a schematic sectional view of a lubricating device for a horizontal type hermetic compressor in accordance with a second embodiment of the present invention, showing an oil sucking operation thereof.
Figure 8:
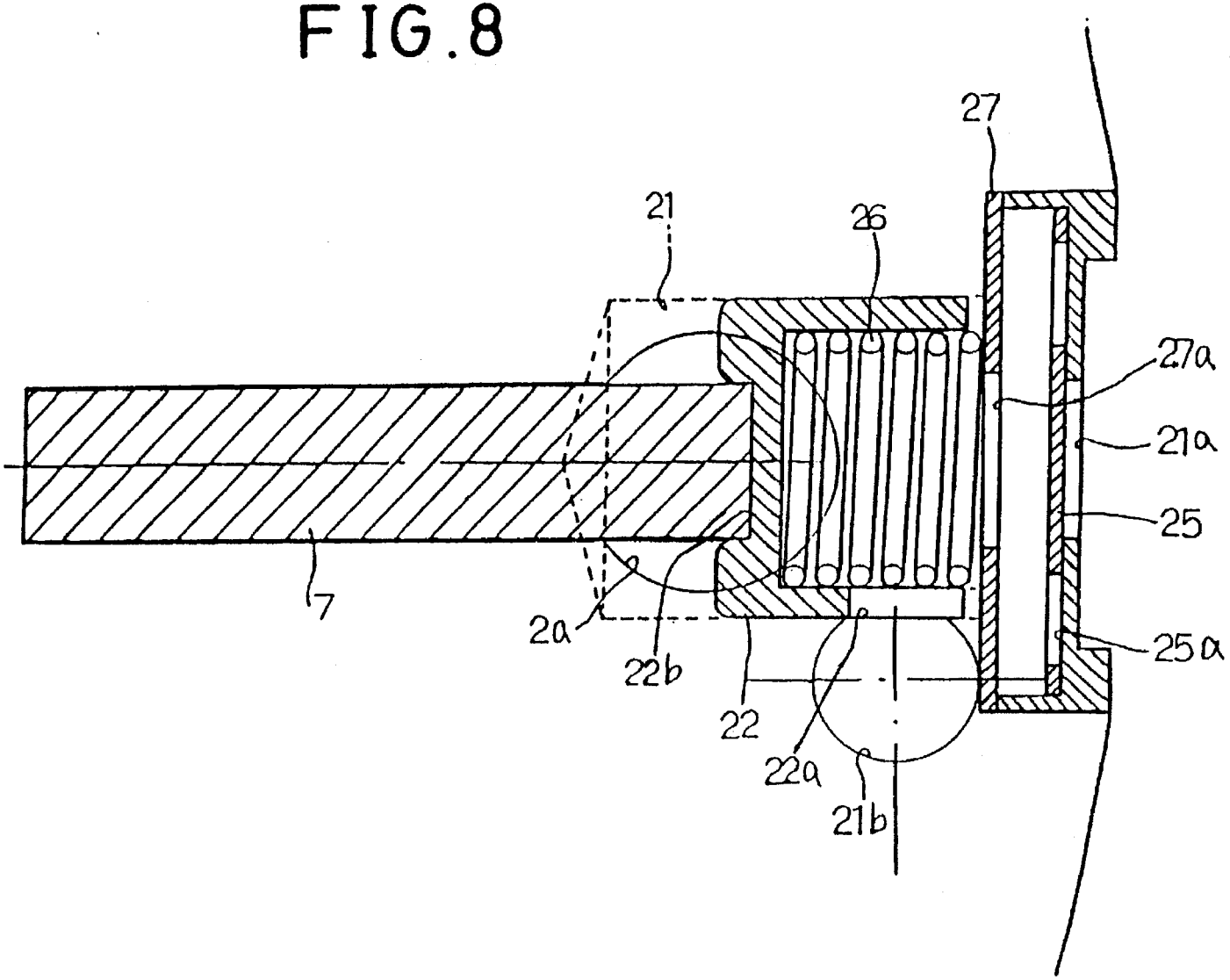
FIG. 8 is a schematic sectional view of the lubricating device of FIG. 7, showing an oil delivering operation thereof.

Turning to FIGS. 7 and 8, there are shown the oil sucking operation and the oil delivering operation of the lubricating device in accordance with second embodiment of the present invention, respectively. In the lubricating device of this second embodiment, a compression coil spring 26 is provided under the oil piston 22. This compression coil spring 26 is supported by a spring support member 27.

In order to prevent introduction of refrigerant into the oil cylinder 21 through a vane slot reference hole 29 and the vane slot 2*a* during the radial advance or the upward movement of the oil piston 21 toward the upper dead point 28, the length $l_1$ of the oil piston 22 should be longer than the distance $l_2$ between the upper dead point 28 and the vane slot reference hole 29.

In addition, a vane seating depression 22*b* is formed on the upper center surface of the oil piston 22 for stably tightly fitting the vane 7 to the piston 22, thus to achieve a desired stable coupling of the vane 7 to the oil piston 22.

In the drawings, FIGS. 7 and 8, the reference numeral 27*a* denotes an oil inlet opening formed in the spring support member 27 for introduction of the lubrication oil from the oil inlet port 21*a* into the oil cylinder 21.

In operation of the lubricating device according to the primary embodiment shown in FIGS. 2 to 6, the eccentric rotation of the shaft 4 causes elastic radial advance and retraction of the vane 7 together with the oil piston 22 since the shaft 4 cooperates with the vane 7 and this vane fixedly connected to the oil piston 22 by the line springs 24 and biased by the restoring forces of the springs 24. The piston 22 thus elastically reciprocates in the oil cylinder 21 and sucks the lubrication oil charged in the casing 1 and delivers the oil to the shaft 4.

That is, when the vane 7 moves leftwards, as shown in FIG. 5, by the rotation of the roller 3 of the eccentric rotating shaft 4 and, as a result, the oil piston 22 fixedly connected to the vane 7 by the springs 24 moves leftwards, there is generated a negative pressure in the oil cylinder 21. The oil valve 25 having closed the oil inlet port 21*a* of the oil cylinder 21 thus moves leftwards in order to open the inlet port 21*a*, thus cause the lubrication oil in the casing 1 to be sucked into the oil cylinder 21 through the oil inlet port 21*a* of the cylinder 21 and the oil inlet hole 25*a* of the oil valve 25.

Thereafter, when the vane 7 moves rightwards, as shown in FIG. 6, by the rotation of the roller 3 and, as a result, the oil piston 22 fixedly connected to the vane 7 moves rightwards, the inner volume of the oil cylinder 21 is compressed. The oil valve 25 having opened the oil inlet port 21*a* thus moves rightwards in order to close the inlet port 21*a*, thus cause the lubrication oil in the cylinder 21 to be delivered to the eccentric rotating shaft 4 through the oil outlet 22*a* of the oil piston 22, the oil outlet port 21*b* of the cylinder 21 and the oil feed pipe 12

As described above, the lubrication oil of the lubricating device of this primary embodiment is repeatedly sucked into and delivered from the oil cylinder 21 in accordance with the reciprocation of the oil piston 22 in the cylinder 21 caused by the radial movement of the vane 7, thus to be supplied to the driving parts of the compressor such as the shaft 4.

In operation of the lubricating device according to the second embodiment shown in FIGS. 7 to 8, the vane 7 moves leftwards, as shown in FIG. 7, by the rotation of the roller 3 of the eccentric rotating shaft 4 and, as a result, the oil piston 22 moves leftwards by the compression coil spring 26. There is thus generated a negative pressure in the oil cylinder 21. The oil valve 25 having closed the oil inlet port 21*a* of the oil cylinder 21 thus moves leftwards in order to open the inlet port 21*a*, thereby causing the lubrication oil in the casing 1 to be sucked into the oil cylinder 21 through the oil inlet port 21*a* of the cylinder 21, the oil inlet hole 25*a* of the oil valve 25 and the oil inlet opening 27*a* of the spring support member 27.

Thereafter, when the vane 7 moves rightwards, as shown in FIG. 8, by the rotation of the roller 3 and, as a result, the oil piston 22 moves rightwards, the oil cylinder 21 is compressed. The oil valve 25 having opened the oil inlet port 21*a* thus moves rightwards in order to close the inlet port 21*a*, thus cause the lubrication oil in the cylinder 21 to be delivered to the eccentric rotating shaft 4 through the oil outlet 22*a* of the oil piston 22, the oil outlet port 21*b* of the cylinder 21 and the oil feed pipe 12.

As described above, the lubrication oil of the lubricating device of this second embodiment is repeatedly sucked into and delivered from the oil cylinder 21 in accordance with the reciprocation of the oil piston 22 in the cylinder 21 caused by both the radial movement of the vane 7 and the restoring force of the compression coil spring 26, thus to be supplied to the driving parts of the compressor.

Figure 9:
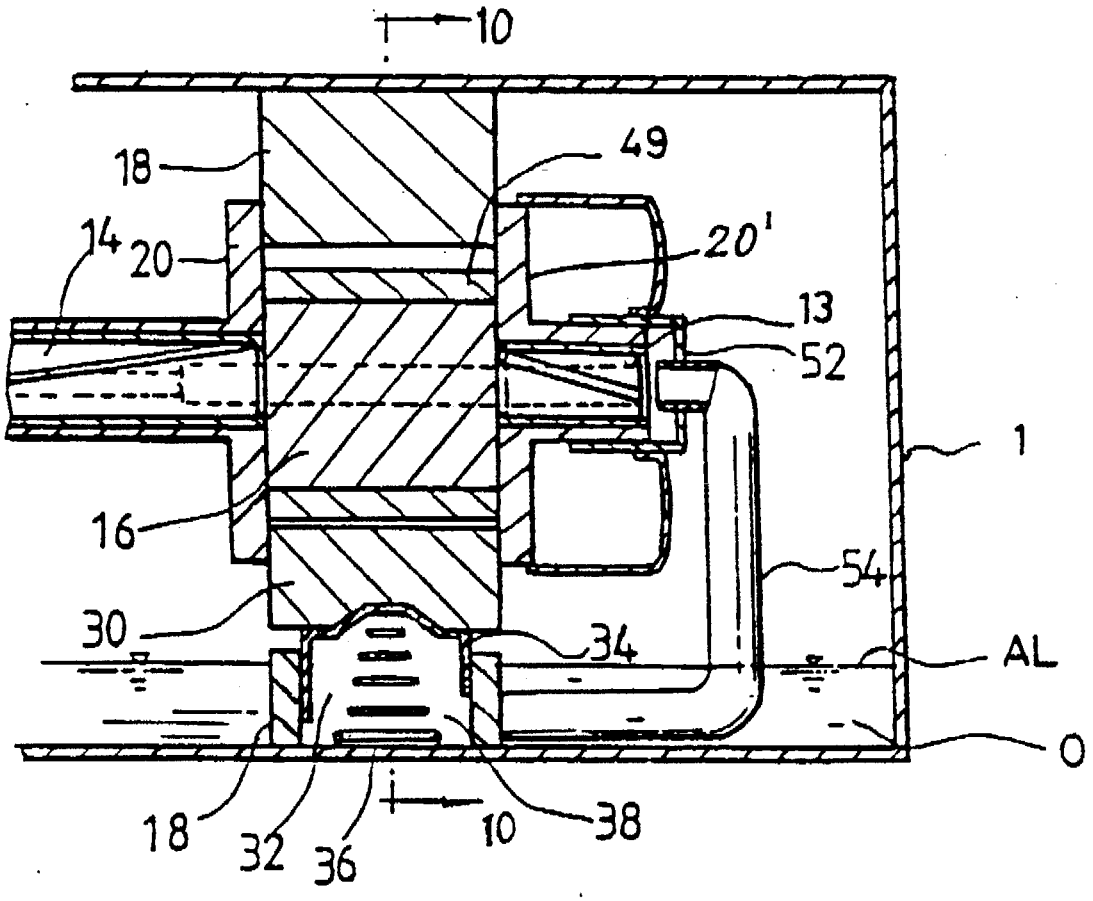
FIG. 9 is a partial sectional view of a lubricating device for a horizontal type hermetic compressor in accordance with a third embodiment of the present invention.
Figure 10:
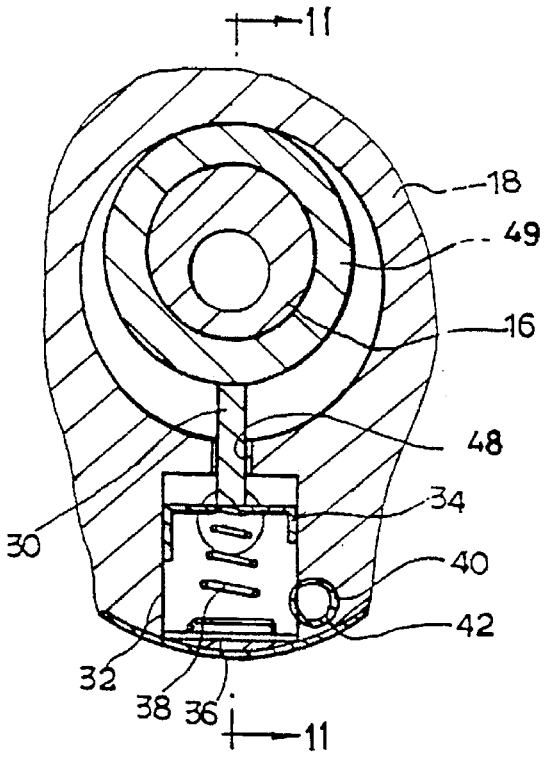
FIG. 10 is a cross sectional view of the lubricating device taken along the section line 10—10 of FIG. 9.

Turning to FIGS. 9 and 10, there is shown a lubricating device for a horizontal type hermetic compressor in accordance with a third embodiment of the present invention.

In the lubricating device of this third embodiment, a crank shaft 16 of a rotating shaft 14 having an axial oil conduit 13 therein is disposed between a sub bearing 20 and a main bearing 20 provided respectively at both sides of a disc cylinder 18 in a compressor casing 1. A rotor 49 is mounted about the crank shaft 16. The compressor casing 1 is charged with the lubrication oil "o" in its lower section such that the oil reaches a predetermined appropriate level AL.

A vane slot 48 is formed at the lower section of the cylinder 18 for receiving a spring-biased vane 30 which elastically reciprocates in accordance with rotation of the crank shaft 16. A pumping chamber 32 is formed under the vane 30 and provided with both an upper spring cap 34 and a lower spring cap 36. A compression coil spring 38 is interposed between the upper and lower spring caps 34 and 38, thus to bias the upper spring cap 34 upwards and to cause the vane 30 to be biased upwards by the upper spring cap 34.

Figure 11:
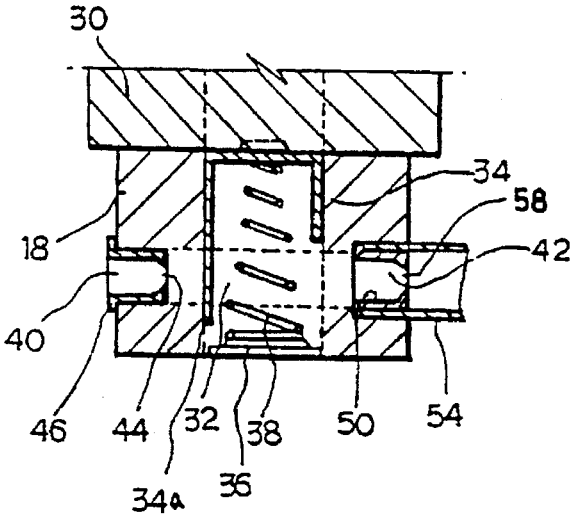
FIG. 11 is a sectional view of the lubricating device taken along the section line 11—11 of FIG. 10.

The pumping chamber 32 is provided with an oil inlet port 40 and an oil outlet port 42 formed on the compression cylinder 18 at positions spaced apart from the vane slot 48 by a predetermined distance. These ports 40 and 42 are opposed to each other as best seen in FIG. 11. An oil inlet diode tip 46 having a nozzle 44 at its side toward the pumping chamber 32 is tightly received in the oil inlet port 40 such that it is exposed and opens to the inside of the casing 1 under the lubrication oil surface in the casing 1. In the same manner, the oil outlet port 42 tightly receives an oil outlet diode tip 50 which has a nozzle 58 at its side opposed to the pumping chamber 32. The oil outlet diode tip 50 is connected to one end of an oil feed pipe 54 of which the other end is connected to a lubricating adapter 52 coupled to the end of the rotating shaft 14.

In the above third embodiment, the vane 30 elastically reciprocates by the rotation of the crank shaft 18. This reciprocation of the vane 30 causes a reciprocation of the upper spring cap 34 in the pumping chamber 32, thus to change the inner volume of the pumping chamber 32. When the inner volume of the pumping chamber 32 is increased, the lubrication oil in the casing 1 is forcibly introduced into the pumping chamber 32 due to the intrinsic structure of the oil inlet diode tip 46 having the nozzle 44 at its side toward the pumping chamber 32. Thereafter, when the inner volume of the pumping chamber 32 is reduced, the lubrication oil in the pumping chamber 32 flows out through the oil cutlet diode tip 50 of the oil outlet port 42 and is in turn fed to the adapter 52 of the shaft 14 through the oil feed pipe 54. The lubrication oil in the adapter 52 is, thereafter, introduced into the oil conduit 13 of the shaft 14 in order to be supplied to the driving parts of the compressor.

In this third embodiment, the upper spring cap 34 has an extension part 34*a* at its section corresponding to the oil inlet port 40. This part 34*a* is longer than the other section of the cap 34 corresponding to the oil cutlet port 42 as best seen in FIG. 11. In this regard, when the lubrication oil in the pumping chamber 32 is delivered through the oil outlet diode tip 50 due to reduction of the inner volume of the chamber 32 caused by lowering of the upper spring cap 34, the extension part 34*a* of the spring cap 34 closes the oil inlet port 40, thus to reliably prevent reverse flow of the lubrication oil from the chamber 32 to the inside of the casing 1.

Figure 12:
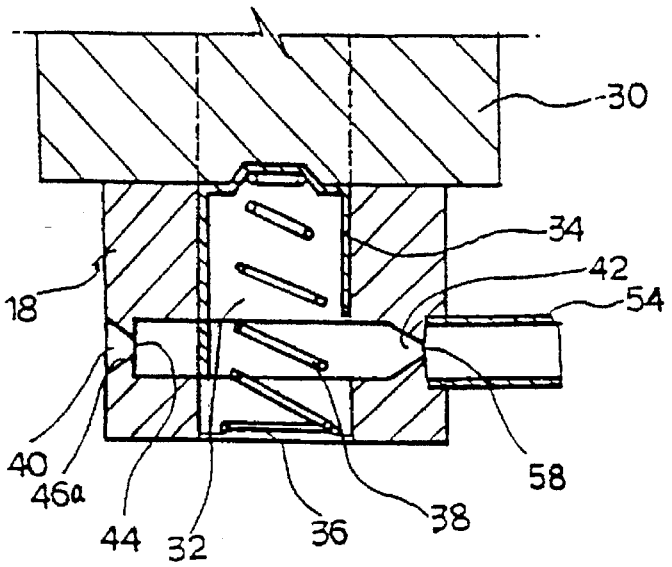
FIG. 12 is a partial sectional view of a lubricating device for a horizontal type hermetic compressor in accordance with a fourth embodiment of the present invention.

FIG. 12 is a partial sectional view of a lubricating device for a horizontal type hermetic compressor in accordance with a fourth embodiment of the present invention. In this embodiment, an oil inlet port 40 and an oil outlet port 42 are integrally formed with an inlet diode 46*a* having a nozzle 44 and an outlet diode 50*a* having a nozzle 58, respectively. In this regard, this embodiment does not use the separate type diode tips 46 and 50 of the third embodiment, so that it provides an advantage in that it reduces the number of elements due to use of no separate type diode tip.

Figure 13:
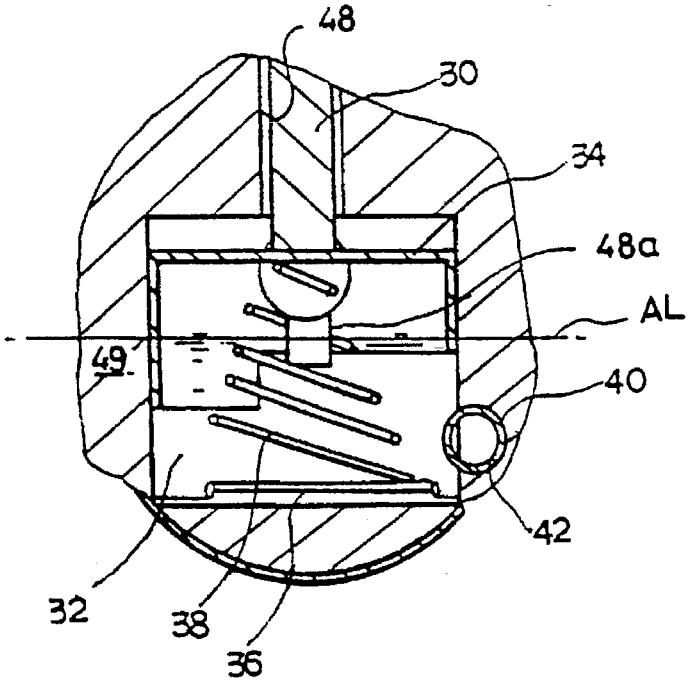
FIG. 13 is a partial sectional view of a lubricating device for a horizontal type hermetic compressor in accordance with a fifth embodiment of the present invention.

Turning to FIG. 13, there is shown a lubricating device for a horizontal type hermetic compressor in accordance with a fifth embodiment of the present invention. This embodiment is for achieving a desired smooth introduction of the lubrication oil from the inside of the casing to the pumping chamber. In order to achieve the above object, the vane slot 48 of this device has an extension part 48*a* extending to the upper section of the pumping chamber 32. When the vane 30 elastically ascends and, as a result, the upper spring cap 34 also ascends in order to increase the inner volume of the pumping chamber 32, the lubrication oil in the inside of the casing 1 is introduced into the pumping chamber 32 through the oil inlet port 40. At this time, the extension part 48*a* of the vane slot 48 communicates with the pumping chamber 32 as the upper spring cap 34 ascends, so that the lubrication oil "o" maintaining its appropriate oil surface AL above the extension part 48*a* is smoothly introduced into the pumping chamber 32 through the extension part 48*a*. Thereafter, the oil suction load in the pumping chamber 32 of this lubricating device is remarkably reduced and, as a result, the desired smooth introduction of the lubrication oil into the pumping chamber 32 is achieved.

As described above, the lubricating device for horizontal type hermetic compressor according to the present invention includes an oil cylinder, functioning as conventional oil pumping chamber, at the back of a spring-biased vane movably received in a compressing cylinder of the compressor, and also includes an oil piston and an oil valve in the oil cylinder. Thanking for the above construction, this lubricating device causes the oil piston to communicate with the oil valve by the movement of the vane arid achieves a desired supply of the lubrication oil through the oil cylinder. Therefore, this device can desirably use conventional horizontal type hermetic compressor with a slight change of its construction, thus to reduce the cost. Another advantage of this device is resided in that the flow rate of the lubrication oil to be delivered is easily precisely controlled thanking for the presence of the oil valve provided in the oil inlet port of the oil cylinder.

In accordance with the present invention, the oil piston is biased by a compression coil spring positioned under the piston, so that it is easy to fabricate the compressor. In addition, since the length of the oil piston is longer than the distance between the upper dead point of the oil pumping chamber and the vane slot reference hole, introduction of refrigerant into the oil cylinder through the vane slot reference hole and the vane slot is reliably prevented. Hence, this lubricating device prevents mixing of the lubrication oil with the refrigerant, thus to stably supply the lubrication oil to the driving parts of the compressor.

In an embodiment of the present invention, the lubricating device does not use the separate type oil inlet and oil outlet diode tips, thus to reduce the number of elements. Furthermore, this device remarkably reduces the oil suction load in the pumping chamber and, as a result, the desired smooth introduction of the lubrication oil into the pumping chamber is achieved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed:

1. A horizontal type hermetic compressor having a horizontal outer casing which is charged with lubrication oil therein, and a rotating shaft with a roller thereabout positioned between a compression cylinder and a main bearing, comprising:

said compression cylinder having a vane slot, a movable vane in the vane slot and an oil cylinder provided at the back of the movable vane, said oil cylinder having an oil inlet port and an oil outlet port;

an oil piston slidably received in said oil cylinder for suction and delivery of said lubrication oil;

a piston connection member fixedly connected to said oil piston in said oil cylinder;

elastic means for fixedly connecting said oil piston to said movable vane for allowing said oil piston to move together with said movable vane;

an oil valve movably provided under said oil piston for selectively closing said oil inlet port of the oil cylinder in accordance with movement of said oil piston in said oil cylinder;

an oil feed pipe connected between said oil outlet port of the oil cylinder and said rotating shaft of the compressor for feeding said lubrication oil from said oil cylinder to said rotating shaft; and wherein said oil valve includes an oil inlet hole and has an outer diameter larger than that of said oil cylinder.

2. A horizontal type hermetic compressor having a horizontal outer casing which is charged with lubrication oil therein, and a rotating shaft with a roller thereabout positioned between a compression cylinder and a main bearing, comprising:

said compression cylinder having a vane slot, a movable vane in the vane slot and an oil cylinder provided at the back of the movable vane, said oil cylinder having an oil inlet port and an oil outlet port;

an oil piston slidably received in said oil cylinder for suction and delivery of said lubrication oil;

a piston connection member fixedly connected to said oil piston in said oil cylinder;

elastic means for fixedly connecting said oil piston to said movable vane for allowing said oil piston to move together with said movable vane;

an oil valve movably provided under said oil piston for selectively closing said oil inlet port of the oil cylinder in accordance with movement of said oil piston in said oil cylinder;

an oil feed pipe connected between said oil outlet port of the oil cylinder and said rotating shaft of the compressor for feeding said lubrication oil from said oil cylinder to said rotating shaft; and wherein the elastic means comprises a plurality of line springs each having one end connected to said piston connection member of said oil piston and another end connected to the vane.

* * * * *